US007441930B2

(12) United States Patent
Lin

(10) Patent No.: US 7,441,930 B2
(45) Date of Patent: Oct. 28, 2008

(54) LED TABLE LAMP

(75) Inventor: Chia-Te Lin, Taipei (TW)

(73) Assignee: AMA Precision, Inc., Taipei (TW)

( * ) Notice: Subject to any disclaimer, the term of this patent is extended or adjusted under 35 U.S.C. 154(b) by 0 days.

(21) Appl. No.: 11/774,360

(22) Filed: Jul. 6, 2007

(65) Prior Publication Data

US 2008/0239723 A1 Oct. 2, 2008

(30) Foreign Application Priority Data

Mar. 27, 2007 (TW) ..... 96110488 A

(51) Int. Cl.
*F21V 21/10* (2006.01)

(52) U.S. Cl. ..... 362/410; 362/800; 362/247; 362/310

(58) Field of Classification Search ..... 362/410, 362/800, 235, 247, 297, 304, 310, 341
See application file for complete search history.

(56) References Cited

U.S. PATENT DOCUMENTS

| | | | | |
|---|---|---|---|---|
| 4,450,513 | A * | 5/1984 | Guggemos | 362/299 |
| 5,542,201 | A * | 8/1996 | Grondal et al. | 40/570 |
| 6,860,629 | B2 * | 3/2005 | Velez | 362/559 |
| 7,090,370 | B2 * | 8/2006 | Clark et al. | 362/183 |
| 2002/0021570 | A1 * | 2/2002 | Just et al. | 362/235 |

* cited by examiner

*Primary Examiner*—Laura Tso
(74) *Attorney, Agent, or Firm*—J.C. Patents

(57) ABSTRACT

An LED table lamp including a base, a holder, and a light emitting device is provided. An end of the holder is connected to the base, and the light emitting device includes a lampshade pivotally connected to another end of the holder, a reflecting thin film and an LED light module. The lampshade has at least a side-wall and a top-wall connected the side-wall. The reflecting thin film is disposed on the top-wall and the LED light module is disposed in the side-wall. The light emitted from the LED light module is reflected several times by the reflecting thin film to render the brightness of the light emitted out of the lampshade substantially uniform.

5 Claims, 2 Drawing Sheets

LED TABLE LAMP

CROSS-REFERENCE TO RELATED APPLICATION

This application claims the priority benefit of Taiwan application serial no. 96110488, filed on Mar. 27, 2007. All disclosure of the Taiwan application is incorporated herein by reference.

BACKGROUND OF THE INVENTION

1. Field of the Invention

The invention relates to a table lamp, and more particularly to a light emitting diode (LED) table lamp.

2. Description of the Related Art

In everyday life, people usually use a table lamp to light up dark areas indoor, such as desk, so users can read or work on the desk without worry visional degeneration due to insufficient light.

In general, the light emitting diode (LED) light is more and more popular due to its small dimension and long service life. FIG. 1 is a schematic diagram showing a current LED table lamp. Referring to FIG. 1, the current LED table lamp 100 includes a base 110, a holder 120 extending from the base 110, and a light emitting device 130. The light emitting device 130 has a lampshade 132 and an LED light module 134. The lampshade 132 in which the LED light module 134 is disposed pivots to the holder 120. The light emitted from the LED light module 134 is directly emitted out of the lampshade 132.

It is taken into consideration that the light emitted from the LED light module 134 is emitted directly out of the lampshade 132, which may cause discomfort to users as the light may be directly directed to the eyes while reading or working. In addition, the lit up area, for example on a desk, generated by light from the LED light module 134 may not be uniform due to the directly lightened region and the indirectly lightened region. Users may feel uncomfortable due to non-uniform brightness in reading or working area.

SUMMARY OF THE INVENTION

According to one embodiment of the present invention, an LED table lamp capable of producing light that can light an area with a substantially uniform brightness.

The LED table lamp, according to an embodiment of the invention, includes a base, a holder and a light emitting device. An end of the holder is connected to the base, and the light emitting device includes a lampshade pivotally connected to another end of the holder, and a reflecting thin film and an LED light module. The lampshade has at least a side-wall and a top-wall connected to the side-wall, wherein the reflecting thin film is disposed on the top-wall and the LED light module is disposed in the side-wall. The light emitted from the LED light module may be emitted out of the lampshade after reflecting from the reflecting thin film.

According to an embodiment of the invention, the light emitting device includes a circuit board and a heat pipe. The LED emitting device is disposed on a surface of the circuit board, and the heat pipe is disposed on the other surface of the circuit board for cooling the LED light module.

According to an embodiment of the invention, the light emitting device includes an optical mixing space to render brightness of the light emitted via the reflecting thin film out of the lampshade substantially uniform.

According to an embodiment of the invention, the LED table lamp includes a lens disposed on the lampshade.

According to an embodiment of the invention, the LED light module is disposed on the side-wall of the lampshade, and the reflecting thin film with better reflectance is disposed on the top-wall of the lampshade. The light emitted from the LED light module can be reflected several times within the light emitting device by the reflecting thin film to increase the uniformity of the optical mixing. Therefore, the light emitting out of the lampshade is uniform in brightness. Thus, the LED table lamp of the invention can produce a light of uniform brightness, and therefore the disadvantages of the light causing discomfort due to light of non-uniform brightness in working area may be effectively reduced.

These and other features, aspects, and advantages of the present invention will become better understood with regard to the following description, appended claims, and accompanying drawings.

DETAILED DESCRIPTION OF THE EMBODIMENT

Figure 1:
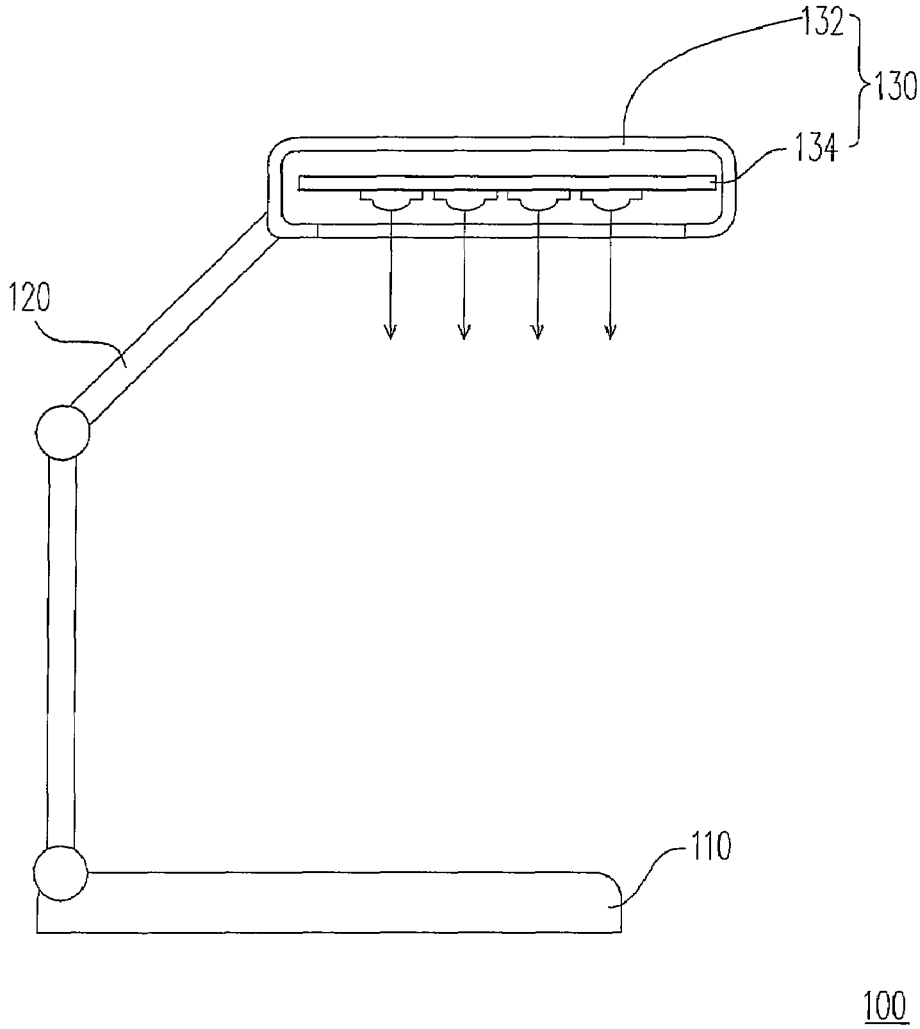
FIG. 1 is a schematic diagram showing a conventional LED table lamp.
Figure 2:
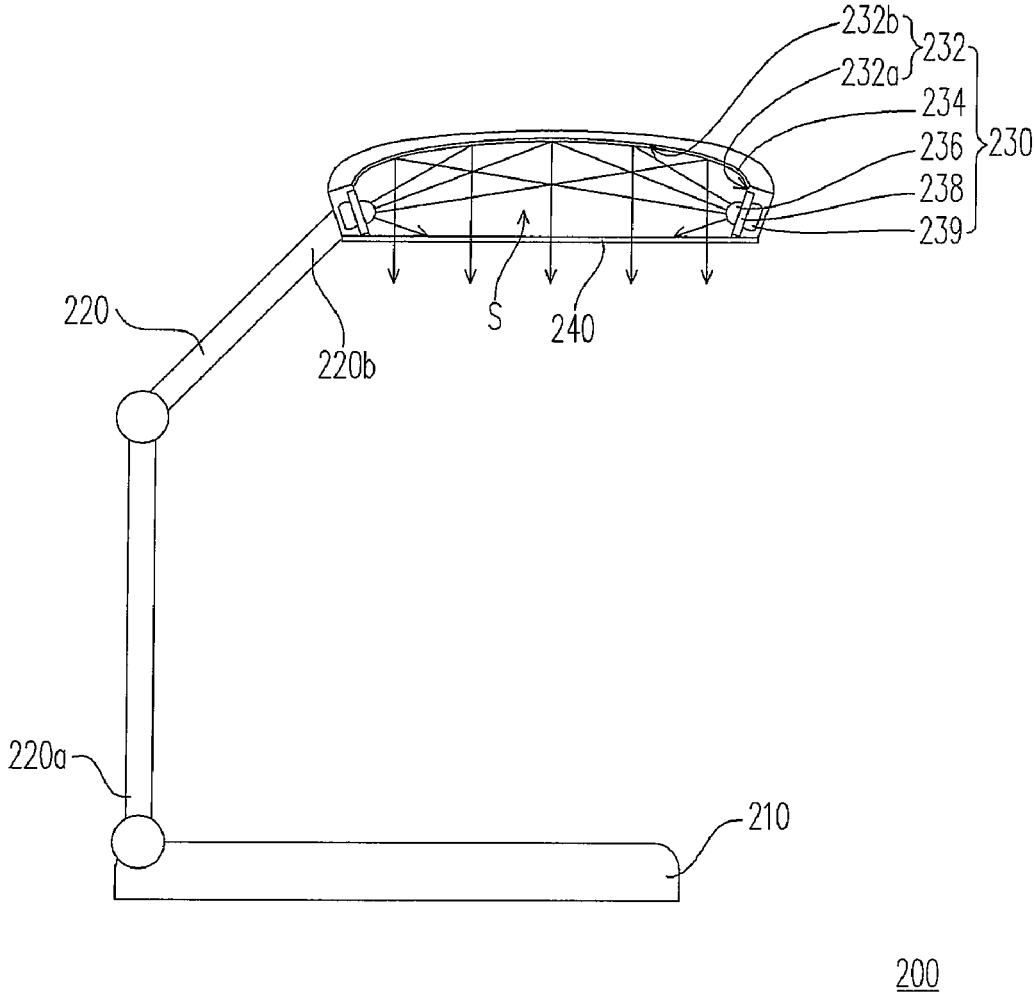
FIG. 2 is a schematic diagram showing an LED table lamp according to an embodiment of the present invention.

FIG. 2 is a schematic diagram showing an LED table lamp according to an embodiment of the present invention. Referring to FIG. 2, the LED table lamp 200 includes a base 210, a holder 220 and a light emitting device 230. In the present embodiment, an end 220*a* of the holder 220 is connected to the base 210, and the light emitting device 230 is pivotally connected to the other end 220*b* of the holder 220. Users can adjust the direction of the light source of the light emitting device 230 to adjust lit up area on the desk or other working stations. Hereinafter, the light emitting device 230 according to the present invention may be described in more detail as follows.

Referring to FIG. 2 again, the light emitting device 230 includes a lampshade 232, a reflecting thin film 234 and an LED light module 236. Wherein the lampshade 232 is pivotally connected to the holder 220 and has at least a side-wall 232*a* (FIG. 2 shows the lampshade 232 with two side-walls 232*a*) and a top-wall 232*b* connected to the side-wall 232*a*. In the present embodiment, the reflecting thin film 234 is disposed on the top-wall 232*b* of the lampshade 232 (for example the reflecting thin film 234 can be formed on the top-wall 232*b* of the lampshade 232 by aluminum vapor deposition), and the LED light module 236 is disposed on the side-wall 232*a* of the lampshade 232. The light emitted from the LED light module 236 is emitted out of the lampshade 232 after undergoing multiple reflections on the reflecting thin film 234.

It is worth mentioning that the LED light module 236 is disposed on the side-wall 232*a* of the lampshade 232 and the reflecting thin film 234 is disposed on the top-wall 232*b* of the lampshade 232, so that the light emitted from the LED light module 236 can be reflected several times within the light emitting device 230 by the reflecting thin film 234 to increase the uniformity of the optical mixing. Therefore, the light emitting out of the lampshade may have a substantially uniform brightness. The light emitting device 230 may include an optical mixing space S, and the light emitted from the LED light module 236 can be mixed within the optical mixing space S during multiple reflections by the reflecting thin film 234 to generate light with uniform brightness.

In addition, according to an embodiment of the present invention, the light emitting device 230 may further include a circuit board 238 and a heat pipe 239. The LED light module 236 may be disposed on a surface of the circuit board 238 and the heat pipe 239 may be disposed on the other surface of the circuit boar 238. The heat pipe 239 an excellent heat conduction efficiency. Thus, the heat generated from the LED light module 236 may be effectively conducted to the heat pipe 239 and then to a cooling element connected to the heat pipe 239 (not shown). Therefore, the LED light module 236 may work at an optimal working temperature.

According to an embodiment of the present invention, the LED table lamp 200 may include a light filter such as a lens 240 disposed on the light path of the lampshade 232, so that the light emitted from the light emitting device 220 is softer.

As described above, in an LED table lamp of the invention, an LED light module is provided on a side-wall of a lampshade, and a reflecting thin film is provided on a top-wall of the lampshade. Therefore, the light emitted from LED light module can be reflected several times within a light emitting device by the reflecting thin film in order to render the brightness of the light substantially uniform via optical mixing.

Accordingly, the present invention has at least the following advantages:

Since the light emitted from the LED light module is reflected several times within the light emitting device by the reflecting thin film to effect a proper optical mixing, the light emitted out from the LED light device may have a substantially uniform brightness. Thus, the discomfort due to light with substantially non-uniform brightness may be effectively avoided. In other words, the LED table lamp of the invention may provide a better reading or working environment.

Since the light emitted from the LED light module is reflected several times within the light emitting device by the reflecting thin film to fully effect the optical mixing before being emitting out of the lampshade, the emitted light may be softer and do not cause discomfort to users' eyes.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An LED table lamp, comprising:

a base;

a holder, comprising an end connected to the base; and a light emitting device, comprising:

a lampshade, pivotally connected to another end of the holder, comprising at least a side-wall and a top-wall connected to the side-wall;

a reflecting thin film, disposed on the top-wall and a part of the side-wall; and at least one LED light module disposed on the side-wall, wherein the LED table lamp further comprises two LED light modules disposed on two opposite side-walls of the lampshade.

2. The LED table lamp according to claim 1, wherein the light emitting device includes a circuit board and a heat pipe.

3. The LED table lamp according to claim 1, wherein the light emitting device includes an optical mixing space to allow multiple reflection of light emitted from the LED module by the reflecting thin film to render a brightness of the light substantially uniform.

4. The LED table lamp according to claim 1, further including a lens disposed on the lampshade.

5. The LED table lamp according to claim 1, wherein the reflecting thin film comprises aluminum.

* * * * *